US008190429B2

(12) United States Patent
Iser et al.

(10) Patent No.: US 8,190,429 B2
(45) Date of Patent: May 29, 2012

(54) PROVIDING A CODEBOOK FOR BANDWIDTH EXTENSION OF AN ACOUSTIC SIGNAL

(75) Inventors: Bernd Iser, Ulm (DE); Gerhard Uwe Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 1036 days.

(21) Appl. No.: 12/047,874

(22) Filed: Mar. 13, 2008

(65) Prior Publication Data

US 2009/0030699 A1 Jan. 29, 2009

(30) Foreign Application Priority Data

Mar. 14, 2007 (EP) ..... 07005313

(51) Int. Cl.
*G10L 19/12* (2006.01)

(52) U.S. Cl. ..... 704/223

(58) Field of Classification Search ..... 704/223, 704/219, 500, 501
See application file for complete search history.

(56) References Cited

U.S. PATENT DOCUMENTS

| | | | | |
|---|---|---|---|---|
| 5,890,108 | A * | 3/1999 | Yeldener | 704/208 |
| 5,924,061 | A * | 7/1999 | Shoham | 704/218 |
| 5,978,759 | A | 11/1999 | Tsushima et al. | |
| 6,202,048 | B1 | 3/2001 | Tsuchiya et al. | |
| 6,233,550 | B1 * | 5/2001 | Gersho et al. | 704/208 |
| 6,275,796 | B1 | 8/2001 | Kim et al. | |
| 6,539,355 | B1 | 3/2003 | Omori et al. | |
| 6,871,176 | B2 * | 3/2005 | Choi et al. | 704/223 |
| 2001/0044722 | A1 | 11/2001 | Gustafsson et al. | |
| 2002/0138268 | A1 | 9/2002 | Gustafsson | |
| 2002/0193988 | A1 * | 12/2002 | Chennoukh et al. | 704/205 |
| 2004/0138876 | A1 * | 7/2004 | Kallio et al. | 704/209 |
| 2004/0138879 | A1 * | 7/2004 | Kim | 704/219 |
| 2004/0153313 | A1 * | 8/2004 | Aubauer et al. | 704/206 |

FOREIGN PATENT DOCUMENTS

| | | | |
|---|---|---|---|
| EP | 1 008 984 | A2 | 12/1999 |
| EP | 1 638 083 | A1 | 9/2004 |

OTHER PUBLICATIONS

J. Epps, W.H. Holmes, "A New Technique for Wideband Enhancement of Coded Narrowband Speech", IEEE Workshop on Speech Coding, Conference Proceedings, pp. 174-176, Jun. 1999.

B. Iser, G. Schmidt, *Bandwidth Extension of Telephony Speech*, EURASIP Newsletter, vol. 16, No. 2, pp. 2-24, Jun. 2005.

U. Kornagel, "Spectral Widening of the Excitation Signal for Telephone-Band Speech Enhancement", IWAENC '01, Conference Proceedings, pp. 215-218, Sep. 2001.

Linde et al, *An Algorithm for Vector Quantizer Design*, IEEE Transactions on Communications, vol. COM-28, No. 1, pp. 84-95, 1980.

European Search Report for Application No. EP 07 00 5313 dated Apr. 27, 2007.

(Continued)

*Primary Examiner* — Jakieda Jackson

(74) *Attorney, Agent, or Firm* — Sunstein Kann Murphy & Timbers LLP

(57) ABSTRACT

A codebook spectral envelope may be used to extend the bandwidth of a bandwidth limited signal. A system includes codebooks that list codebook spectral envelopes. A codebook spectral envelope may be selected based on a characteristic of the spectral envelope of the bandwidth limited signal. Modifications of selected codebook spectral envelopes may generate a bandwidth extension signal that may be added to the bandwidth limited signal to improve the quality of the signal.

20 Claims, 11 Drawing Sheets

OTHER PUBLICATIONS

Jax, P. "Enhancement of Bandwidth Limited Speech Signals: Algorithms and Theoretical Bounds", Published Dissertation, Aachen, Germany 2002. 1-94.

Jax, P. "Bandwidth Extension for Speech." *Audio Bandwidth Extension*. Ed. E. Larson and R. M. Aarts. New Jersey: Wiley Books, 2004. 1-33.

* cited by examiner

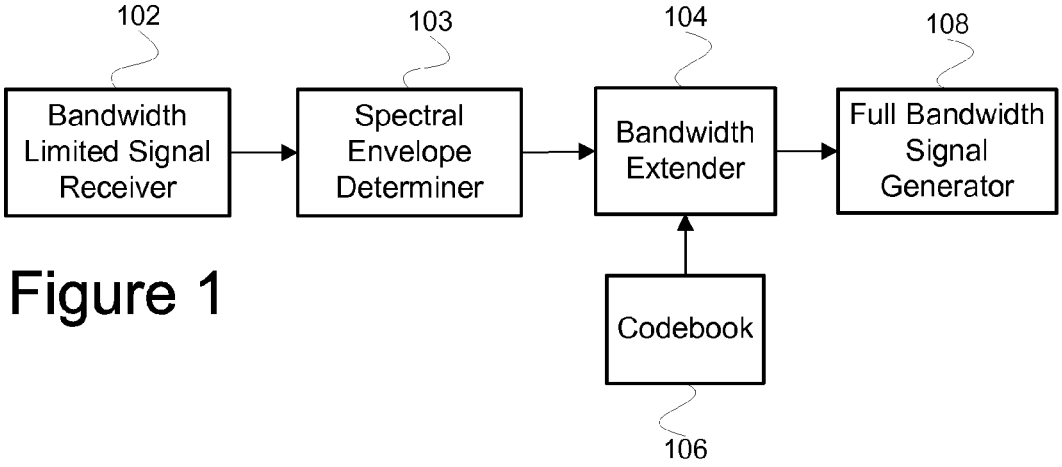
Figure 1
Figure 2
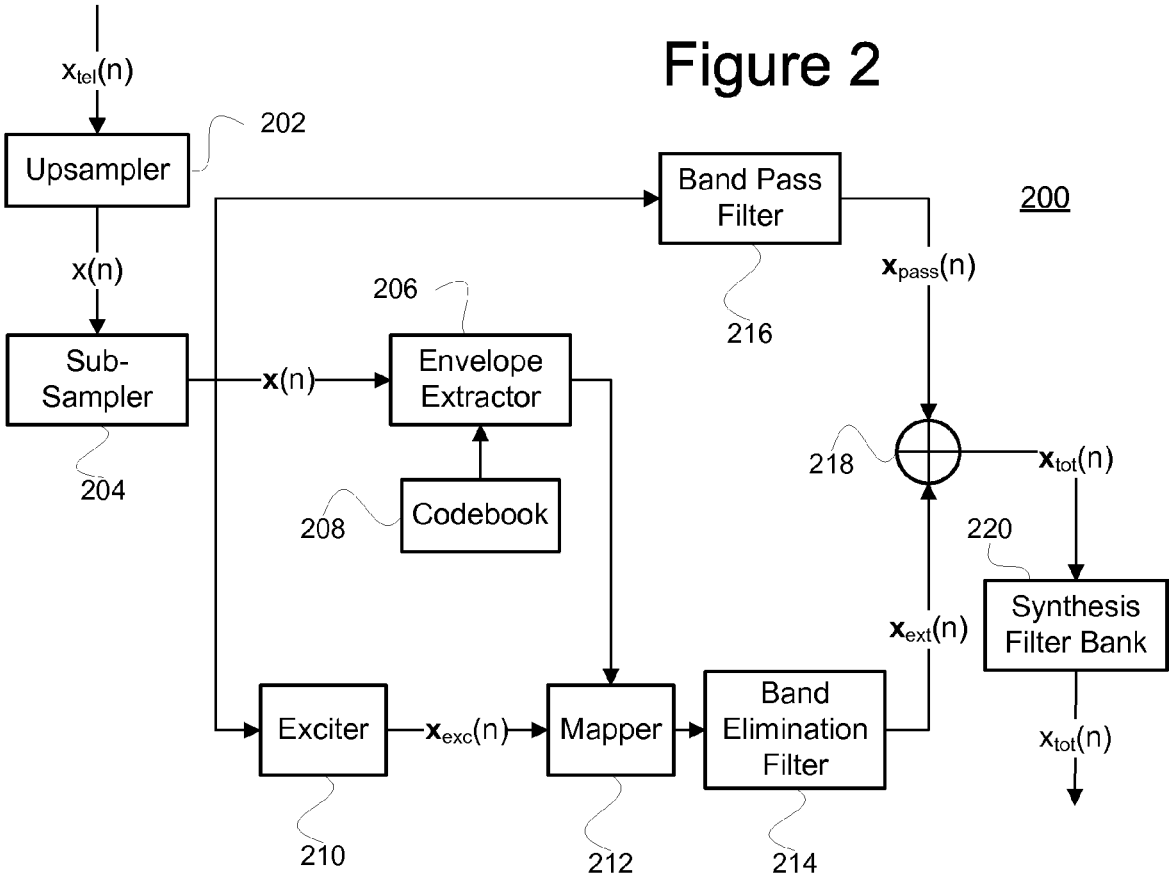

400

500

PROVIDING A CODEBOOK FOR BANDWIDTH EXTENSION OF AN ACOUSTIC SIGNAL

PRIORITY CLAIM

This application claims the benefit of priority from European Patent Application No. 07005313.7, filed on Mar. 14, 2007, which is incorporated by reference.

BACKGROUND OF THE INVENTION

1. Technical Field

This application relates to a system for providing a codebook spectral envelope for bandwidth extension of a signal.

2. Related Art

Signals transmitted via an analog or digital signal path may be limited by the bandwidth of that signal path. The restricted bandwidth may result in a transmitted signal that differs from the original signal. When the signal is an acoustic speech signal for a telephone connection, the required sampling rate of the connection may result in a maximum bandwidth for the signal. The limited signal bandwidth may reduce the speech and audio qualities of the original acoustic signal. In one example, the limited bandwidth may result in a lack of high frequencies for a speech signal that may reduce the intelligibility of the speech and/or result in missing low frequency components that may degrade speech quality.

A bandwidth may be increased by using broadband or wideband digital coding and decoding. The coding/decoding may require the transmitter and the receiver to support the corresponding coding/decoding, which may require standard coding. Alternatively, bandwidth extension may be used upon receiving a transmission so that the existing connection may remain bandwidth limited. The missing frequency components of the original bandwidth limited signal may be estimated and added to the signal.

SUMMARY

A codebook spectral envelope may be used to extend the bandwidth of a bandwidth limited signal. A system includes codebooks that list codebook spectral envelopes. A codebook spectral envelope may be selected based on a characteristic of the spectral envelope of the bandwidth limited signal. Modifications of selected codebook spectral envelopes may generate a bandwidth extension signal that may be added to the bandwidth limited signal to improve the quality of the signal.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 1 is a system for expanding a signal.

FIG. 2 is a bandwidth expansion system.

DETAILED DESCRIPTION OF THE PREFERRED EMBODIMENTS

Figure 3:
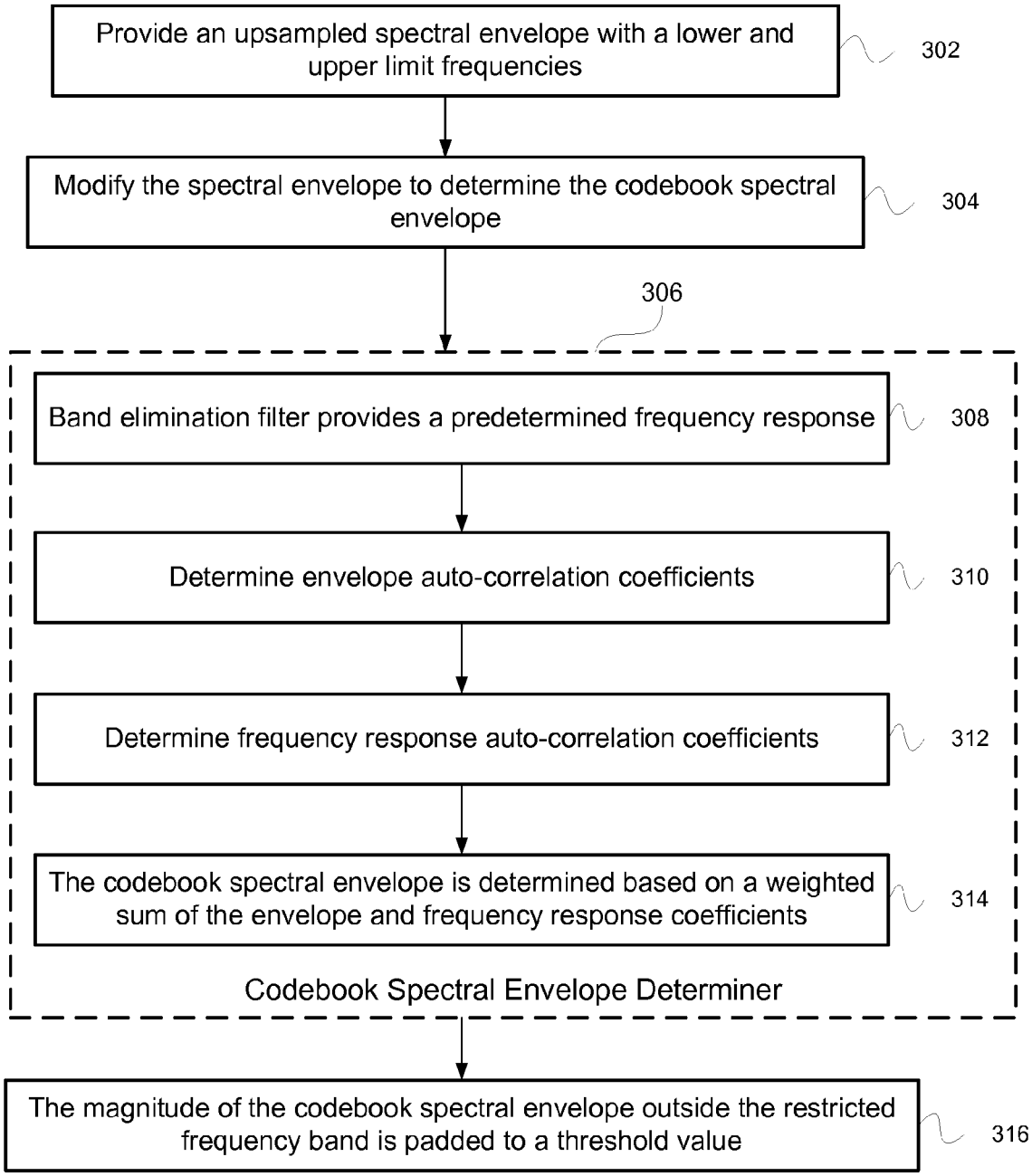
FIG. 3 is a process that provides a codebook spectral envelope.

FIG. 1 is a system that expands a bandwidth of a signal. A bandwidth limited signal receiver 102 receives a signal that is transmitted to a spectral envelope determiner 103 that detects a spectral envelope from the received signal to an extender 104. The extender 104 may utilize a codebook 106 and the detected spectral envelope of the received signal to transmit a full bandwidth signal with a bandwidth extension signal generator 108. The bandwidth limited signal at the receiver 102 may include an acoustic signal, such as a voice or speech. Bandwidth constraints may require that the signal be reduced to the bandwidth limited signal that is received by the receiver 102. The bandwidth limited signal may correspond to the bandwidth of a telephone band, such as an analog telephone band, a GSM telephone band and/or an ISDN telephone band. To improve the quality of the signal, the limited bandwidth may be extended by the extender 104 to generate the full bandwidth signal at the generator 108.

The codebook 106 may be used to determine a codebook spectral envelope which may be used to generate the full bandwidth signal at the generator 108. The codebook spectral envelope may be compared with the spectral envelope of the received signal from the spectral envelope determiner 103. The codebook 106 may represent a plurality of codebooks that may be accessed by the bandwidth extender 104. The codebook 106 may be used to analyze the narrow frequency-band with a look-up in the codebook 106. The codebook 106 may include a codebook index that is matched with a filter that may shape an excitation signal. The excitation signal may be created by an aliasing/folding process in one example. The codebook 106 may be used to translate from the narrowband speech signal received at the receiver 102 to the wideband speech signal from the generator 108. The translation from narrowband to wideband may be based on narrowband speech analysis or wideband speech synthesis. The codebook 106 may be trained on speech data to learn the diversity of speech sounds (phonemes). Alternatively, for other acoustic signals, the codebook 106 may be trained based on the characteristics of that acoustic signal. When using the codebook 106, narrowband speech may be modeled and the codebook entry that represents a minimum distance to the narrowband model may be searched for. The selected model may be used to convert a narrowband signal to its wideband equivalent, which may synthesize the wideband speech.

The bandwidth extender 104 may select a codebook spectral envelope based on a codebook selection that is used for extending the bandwidth limited signal to generate the full bandwidth signal. FIG. 3 is a process that provides a codebook spectral envelope. An upsampled spectral envelope may be restricted to a frequency band with a lower limit frequency and an upper limit frequency at 302. The spectral envelope may be modified to determine the codebook spectral envelope at 304.

The envelope may be a signal, such as an acoustic signal, that may be provided based on a predetermined reference signal. The upsampled spectral envelope may be identified by restricting the envelope signal to the restricted frequency band (a narrowband envelope), and upsampling the envelope signal. In one example, the upsampling may be performed with respect to the sampling rate of the narrowband envelope signal and/or the underlying narrowband reference signal. The upsampled spectral envelope may be expressed by a coefficients vector. In one example, a Linear Predictive Coding (LPC) coefficients vector may be used to determine a spectral envelope based on a reference signal.

The codebook spectral envelope may be determined by a codebook spectral envelope determiner 306. The codebook spectral envelope determiner 306 may include a band elimination filter that provides a predetermined frequency response at 308. The elimination band may correspond with the restricted frequency band. The frequency response of the band elimination filter may be used to modify or regularize the upsampled spectral envelope to obtain a modified spectral envelope with a predetermined magnitude. The predetermined frequency response of the band elimination filter may have a substantially constant magnitude below the lower limit frequency and/or above the upper limit frequency, respectively. The substantially constant magnitude below the lower limit frequency and the substantially constant magnitude above the upper limit frequency may or may not be equal in exemplary systems. The magnitude of the predetermined frequency response of the band-elimination filter may be about −20 dB for frequencies below the lower limit frequency and/or about 0 dB for frequencies above the upper limit frequency in an exemplary system.

Envelope auto-correlation coefficients of the upsampled spectral envelope may be determined at 310. Frequency response auto-correlation coefficients of the frequency response may be determined at 312. In one system, the band-elimination filter may be a finite impulse response (FIR) filter and the frequency response autocorrelation coefficients may be based on an inverse Fourier transform of the absolute values squared of the filter coefficients of the band-elimination filter that have been transformed to the frequency domain. The codebook spectral envelope may be determined at 314 using modified auto-correlation coefficients based on a weighted sum of the input signal auto-correlation coefficients and the frequency response auto-correlation coefficients.

The codebook spectral envelope that is determined at 304 or 306 may have a magnitude that is outside the restricted frequency band. The magnitude of the codebook spectral envelope may be padded to a predetermined threshold value at 316. In various exemplary systems, the predetermined threshold value may be at least −40 dB, at least −20 dB, or at least −15 dB. The predetermined threshold may be obtained using a predetermined weighting or damping factor for the frequency response auto-correlation coefficients. The padded codebook spectral envelope may be equal to or larger than the predetermined threshold outside the restricted frequency band. The narrowband codebook spectral envelope with a restricted frequency band may improve a determination of an adequate codebook envelope during the process of bandwidth extension. In one example, the best matching codebook envelope may be selected based on a comparison of the signal components within the restricted frequency band.

In an alternative system, there may be multiple codebooks. A first and second codebook having sets of spectral envelopes may be used. The spectral envelopes may correspond with one another. Alternatively, the second codebook may have an extended bandwidth compared to the corresponding spectral envelope of the first codebook. An input signal may be limited to a restricted frequency band with a lower and upper limit frequency. A spectral envelope from the first codebook that shows a close match with the spectral envelope of the received input signal may be selected. A spectral envelope from the second codebook that corresponds with the selected spectral envelope from the first codebook may be selected. An extension signal that is based on the selected spectral envelope of the second codebook may be generated for extending the received input signal.

FIG. 2 is a bandwidth expansion system 200. The system 200 may receive a bandwidth limited signal and transmit an estimated full bandwidth signal. An incoming signal $x_{tel}(n)$ with a restricted bandwidth may be received by an upsampler 202. The incoming signal $x_{tel}(n)$ may be an acoustic or audio signal that may include a voice or speech signal, such as a telephone audio transmission. The received signal $x_{tel}(n)$ may be converted to an increased bandwidth by increasing the sampling rate with the upsampler 202. The variable n may denote the time. The conversion by the upsampler 202 may limit the generation of additional frequency components with anti-aliasing or anti-imaging filtering elements. The bandwidth extension may be performed within the missing frequency ranges. Depending on the transmission type, the extension may include low frequency (e.g., about 0 to about 200 Hz) and/or high frequency (e.g., from about 3,700 Hz to about half of the desired sampling rate) ranges. The converted signal x(n) output from the upsampler 202 may include a full bandwidth signal.

The converted signal x(n) may be received by a sub-sampler 204. The sub-sampler 204 may extract and sub-sample the converted signal x(n) to obtain narrowband signal vectors x(n). The narrowband signal vectors x(n) may be received by an envelope extractor 206 that may extract a narrowband spectral envelope from the narrowband signal vector x(n). In one example, the narrowband signal vector x(n) may be restricted by the bandwidth restrictions of a telephone channel. The spectral envelope generated by the envelope extractor 206 may be part of a codebook 208. A corresponding broadband envelope may be estimated by a mapper 212 based on the spectral envelope. The mapping from the mapper 1105 may be based on codebook pairs.

The narrowband signal x(n) may be received by an exciter 210. The exciter 210 may generate a broadband or wideband excitation signal $x_{exc}(n)$ that may have a spectrally flat envelope from the narrowband signal. The excitation signal $x_{exc}(n)$ may correspond with a signal that may be recorded directly behind the vocal chords (e.g., the excitation signal may contain information about voicing and pitch). To retrieve a complete signal, such as a speech signal, the excitation signal $x_{exc}(n)$ may be weighted with the spectral envelope. For the generation of excitation signals, non-linear characteristics such as two-way rectifying or squaring may be used.

For bandwidth extension, the excitation signal $x_{exc}(n)$ may be spectrally colored using the spectral envelope in the mapper 212. The spectral ranges used for the extension may be extracted using a band-elimination filter 214, which may generate an extension signal $x_{ext}(n)$. The band-elimination filter 214 may be utilized in the range from about 200 to about 3,700 Hz in one example. The signal vectors x(n) may also be passed through a complementary band pass filter 216 that generates a band pass filtered signal $x_{pass}(n)$. The signal components $x_{ext}(n)$ and $x_{pass}(n)$ may be summed by adder 218 to obtain a signal $x_{tot}(n)$ with an extended bandwidth. A synthesis filter bank 220 may receive the different signal vectors from the signal $x_{tot}(n)$ and perform a block concentration and oversampling to generate an output signal $x_{tot}(n)$ having an extended bandwidth.

Additional elements or components may be present in the system 200. In one example, a pre-emphasis and/or a de-emphasis may be performed. Alternatively, the power of the spectra of the time domain vectors $x_{tel}(n)$ and $x_{ext}(n)$ may be adapted. The signal processing may be performed in either the frequency domain using FFT and/or IFFT or may be performed in the time domain.

Depending on the quality of anti-aliasing or anti-imaging filtering performed after the upsampling by the upsampler 202 (for example, from a sampling rate of about 8 kHz to a sampling rate of about 11 kHz or about 16 kHz), artifacts at the band limits and additional components in the regions outside the restricted frequency band may appear.

Figure 4:
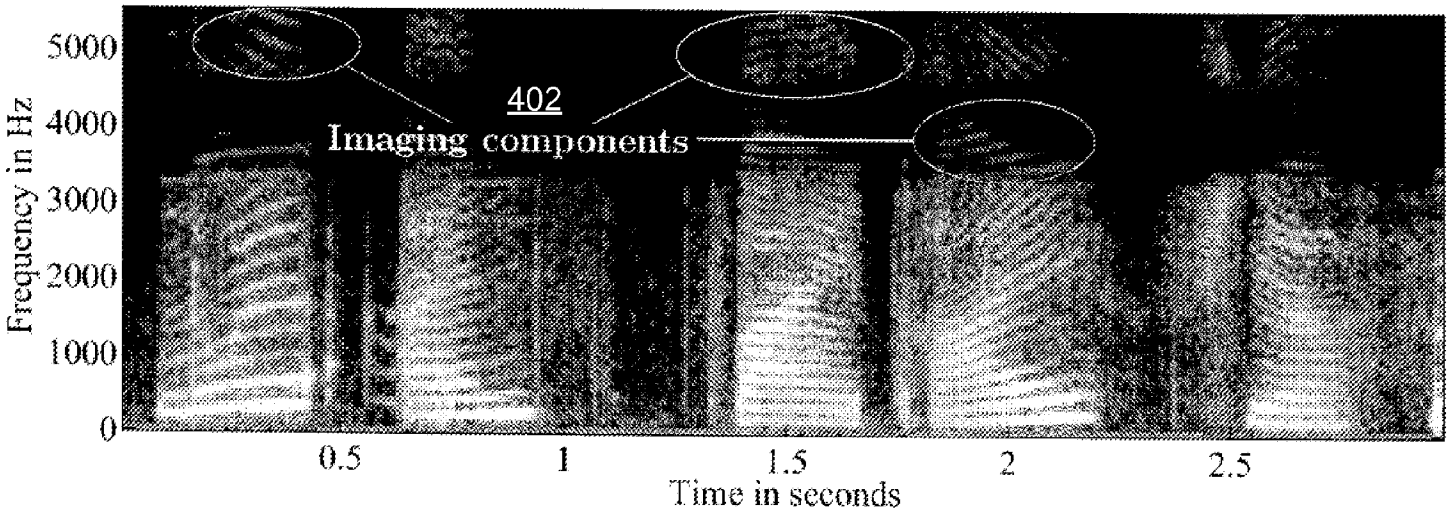
FIG. 4 is an upsampled spectrogram.
Figure 5:
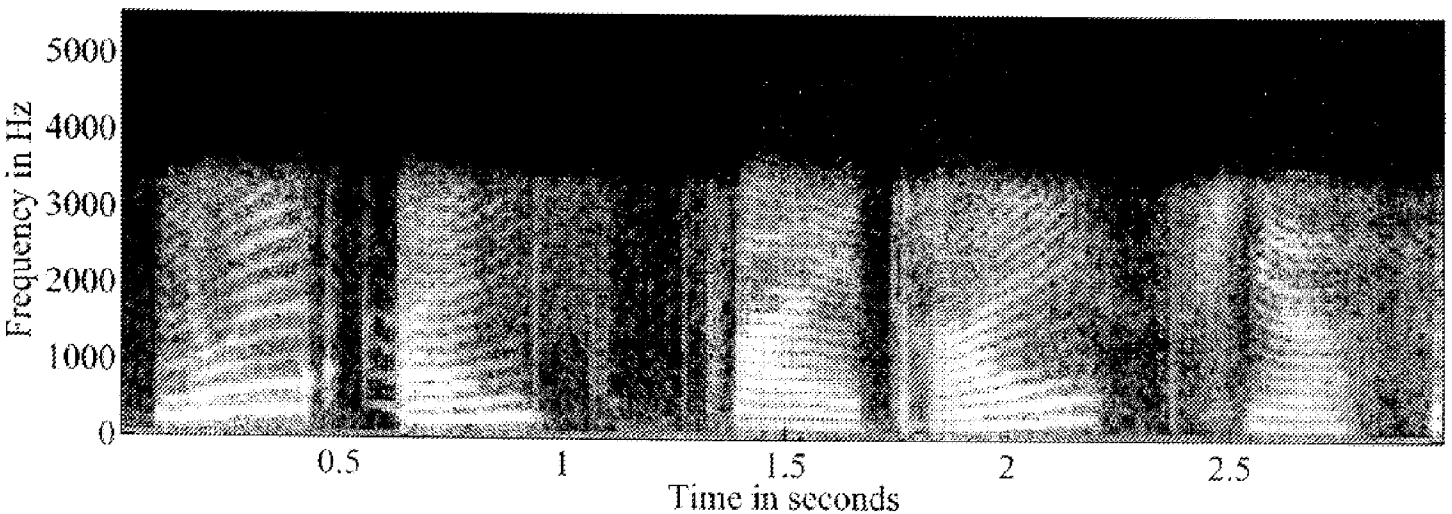
FIG. 5 is an alternative upsampled spectrogram.

FIG. 4 is an upsampled spectrogram 400 with a lower quality upsampling of a speech signal. FIG. 5 is an alternative upsampled spectrogram 500 with a higher quality upsampling of a speech signal. The higher quality spectrogram 500 may be the result of upsampling over the restricted frequency band with no additional components. Conversely, the lower quality spectrogram 400 may be the result of upsampling with lower quality results including imaging components 402 that may be visible outside of the frequency band. The envelope signals used in codebooks may be trained on signals that are not distorted and/or do not produce imaging components, such as the imaging components 402 in FIG. 4.

Figure 6:
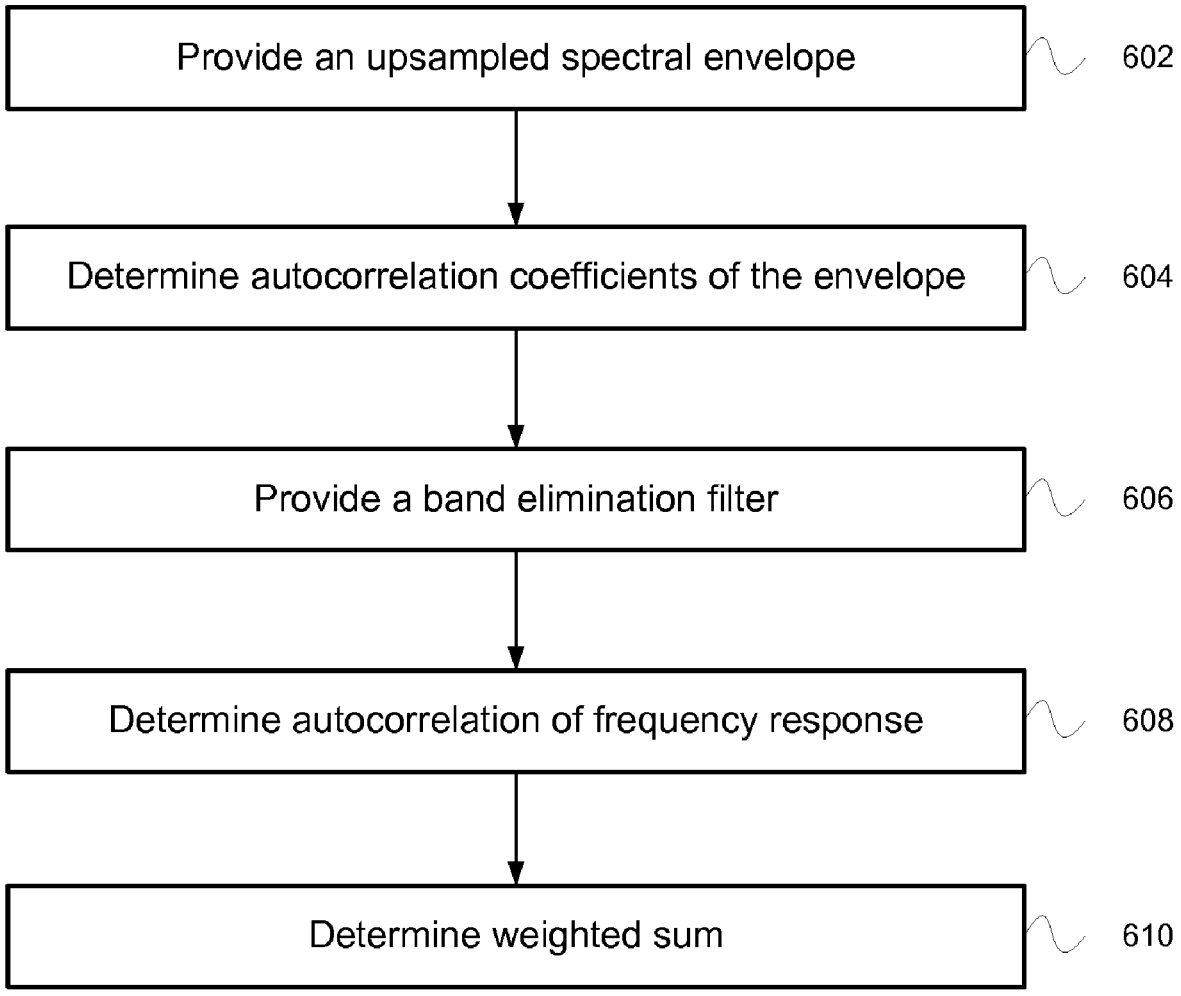
FIG. 6 is a process that provides a codebook spectral envelope.

FIG. 6 is a process providing a codebook spectral envelope for bandwidth expansion of an acoustic signal. The processes illustrated in FIG. 6 may be performed in a different order and/or in parallel with other processes. An upsampled narrowband spectral envelope is provided at 602. The upsampled narrowband spectral envelope (or, alternatively, the narrowband spectral envelope prior to upsampling) may be part of a codebook, such as the codebook 106 or the codebook 208. In some systems, codebook pairs may be provided. A first codebook may include a set of narrowband spectral envelopes and a second codebook may include a set of broadband spectral envelopes. The broadband spectral envelopes in the second codebook may correspond with a narrowband spectral envelope in the first codebook. The codebook size may range from 32 to 1,024 envelopes in an exemplary process. Codebooks may be created and trained using a speech database, such as with the Linde, Buzo, and Gray ("LBG") vector quantization method or the enhanced LBG method.

Figure 7:
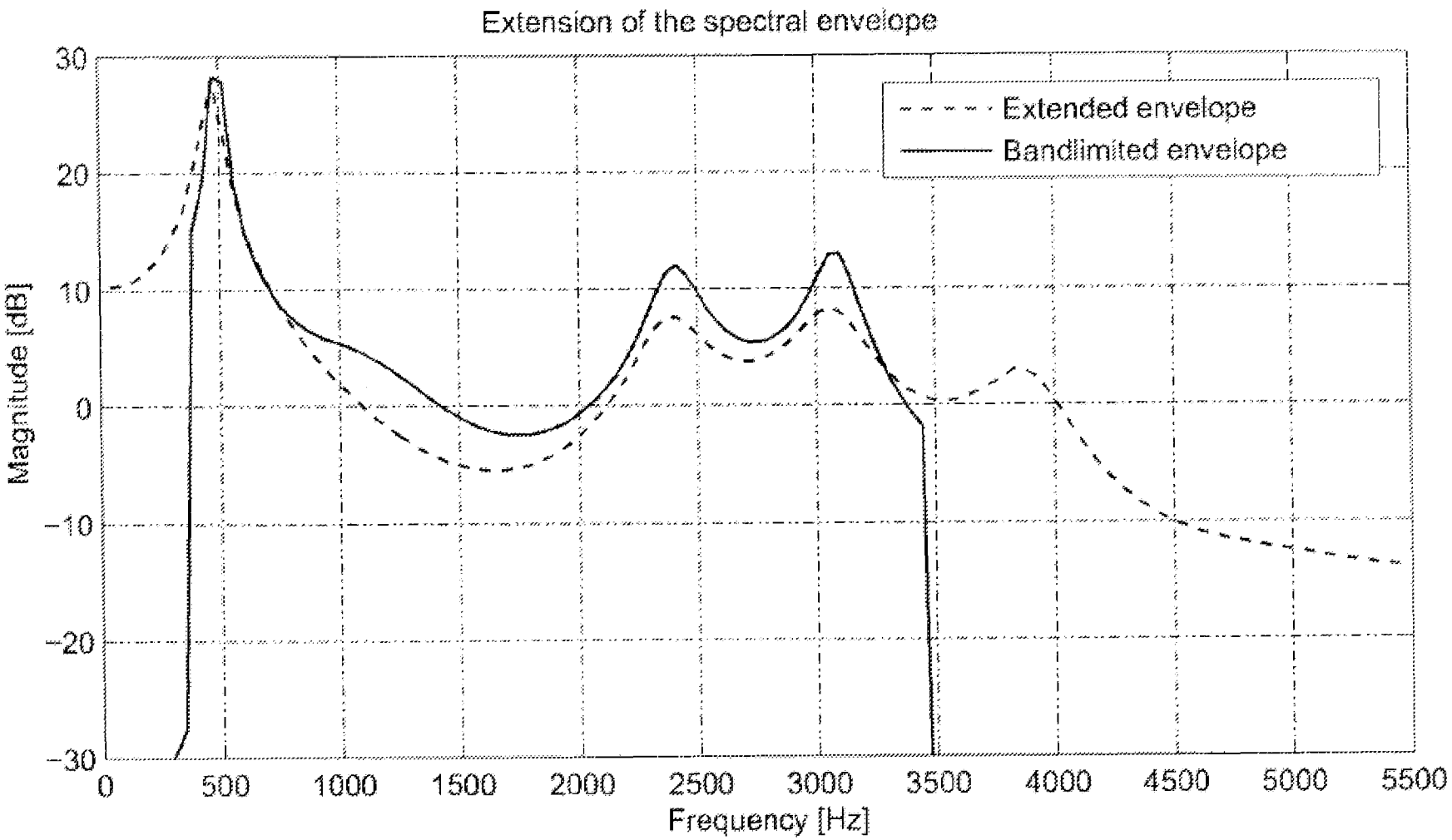
FIG. 7 is a graph of an exemplary codebook pair.

FIG. 7 is a graph of an exemplary codebook pair. The magnitude (dB) of an extended envelope is compared with the magnitude of a bandwidth limited envelope. The band-limited (narrowband) spectral envelope may lie within a restricted frequency band. As shown in FIG. 7, the restricted frequency band may range from approximately 300 Hz to about 3,400 Hz. The corresponding broadband envelope may extend to frequencies below and above the limit frequencies of the narrowband envelope.

In FIG. 6, auto-correlation coefficients of the upsampled spectral envelope may be determined at 604. The auto correlation coefficients may be determined using linear predictive coding (LPC):

$$\tilde{r}_{LPC}(n) = [\tilde{r}_{LPC,0}(n), \tilde{r}_{LPC,1}(n), \ldots \tilde{r}_{LPC,N_{ACF}-1}(n)]^T,$$

with $$\tilde{r}_{LPC,i}(n) = \frac{1}{N_{Block} - i - 1} \sum_{k=0}^{N_{Block}-i-1} s(n+k)s(n+k+i),$$

where $N_{Block}$ represents the length of the extracted signal block, n denotes the current index of the first sampling cycle of the current frame, and s(n) denotes the underlying acoustic signal corresponding to the envelope. The underlying signal s(n) is a narrowband signal restricted to a particular restricted frequency band (for example, due restrictions of a telephone connection). Before calculating the auto-correlation coefficients, the signal s(n) may have undergone a sampling rate conversion (upsampling) to a desired sampling rate. In one example, the upsampling may be to about 11 kHz or about 16 kHz. The parameter $N_{ACF}$ denotes the order of the LPC analysis, where $$N_{Block} \geq N_{ACF}.$$

The auto-correlation coefficients vector may further be normalized according to $$r_{LPC}(n) = \frac{\tilde{r}_{LPC}(n)}{\tilde{r}_{LPC,0}(n)}.$$

These auto-correlation coefficients may be used for determining corresponding LPC coefficients that may be transformed into linear spectral frequency (LSF) coefficients or cepstral coefficients.

Figure 8:
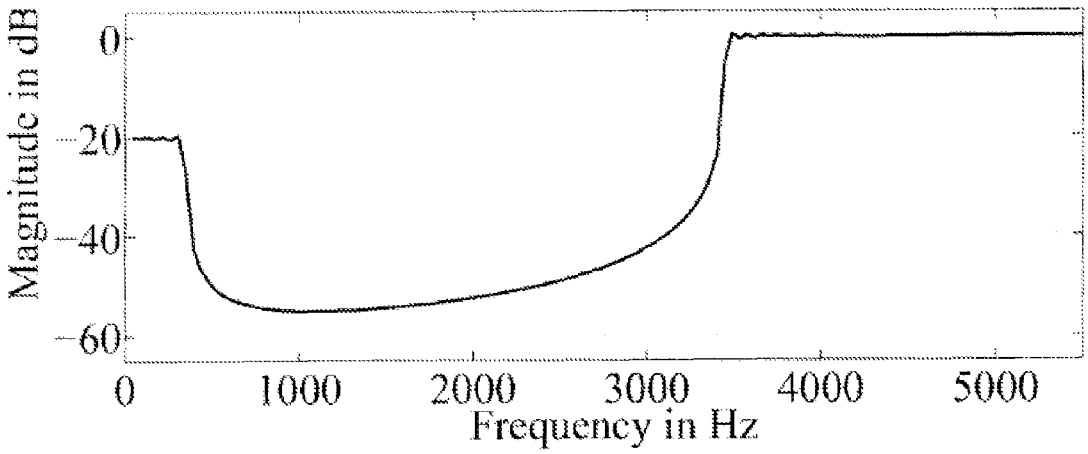
FIG. 8 is a graph of an exemplary frequency response of a band elimination filter.

A band elimination filter may be provided at 606. The band elimination filer may be used to modify the upsampled narrowband spectral envelope. In one system, a finite impulse response (FIR) filter of the order $N_{FIR}$ with the coefficients $$b = [b_0, b_1, \ldots, b_{N_{FIR}-1}]^T$$

may be used. The FIR filter may be chosen such that a predefined modification or regularization frequency response for modifying the narrowband spectral envelope may be obtained. In one example, a frequency response may show a damping of about 20 dB in the frequency range below the lower limit of the narrowband spectral envelope, such as between about 0 Hz and about 200 Hz. Within the restricted frequency band of the spectral envelope, the filter may have a band-elimination characteristic. Above the upper limit of the restricted frequency band, the filter may have a damping characteristic. An exemplary frequency response is shown in FIG. 8. The exemplary frequency response in FIG. 8 has a damping characteristic of about 0 dB above the upper limit of about 3400 Hz. A suitable frequency response may be obtained using a least squares algorithm in one system.

The modification or regularization of the upsampled spectral envelope may be performed in the time domain or in the frequency domain. The modification or regularization of the upsampled spectral envelope is performed in the frequency domain. The filter coefficients may be transformed using a Discrete Fourier Transform (DFT):

$$B = F\{b\},$$

with $$B\left[B\left(e^{j\frac{2\pi}{N_{DFT}}0}\right), B\left(e^{j\frac{2\pi}{N_{DFT}}1}\right), \ldots, B\left(e^{j\frac{2\pi}{N_{DFT}}(N_{DFT}-1)}\right)\right]^T,$$

where F{ } denotes the DFT operator.

Auto-correlation coefficients may be determined for the regularization filter at 608. In particular, the auto-correlation coefficients may relate to the frequency response. In one system, the determination of the auto-correlation coefficients of the spectral envelope may occur parallel to or after the determination of the auto-correlation coefficients for the filter frequency response.

An Inverse Discrete Fourier Transform (IDFT) of the absolute values squared of the filter coefficients in the frequency domain may be performed:

$$r = F^{-1}\{B_Q\},$$

where $$B_Q = \left[\left|B\left(e^{j\frac{2\pi}{N_{DFT}}0}\right)\right|^2, \left|B\left(e^{j\frac{2\pi}{N_{DFT}}1}\right)\right|^2, \ldots, \left|B\left(e^{j\frac{2\pi}{N_{DFT}}1}\right)\right|^2\right]^T$$

and $$r = [r_0, r_1, \ldots, r_{N_{DFT}-1}]^T.$$

In these equations, $F^{-1}\{\ \}$ denotes the Inverse Discrete Fourier Transform.

The modification vector for the additive regularization may be:

$$r_{mod}=[r_{mod,0}, r_{mod,1}, \ldots, r_{mod,N_{ACF}-1}]^T,$$

With the normalized auto-correlation coefficients determined as $$r_{mod} = \mu\frac{W_{cut}r}{r_0},$$

where μ is a damping factor for controlling the padding of the spectral envelope and $W_{cut}$ is a $N_{ACF}\times N_{DFT}$ matrix with the structure:

$$W_{cut} = \begin{bmatrix} w_{1,1} & 0 & \ldots & 0 & 0 & \ldots & 0 \\ 0 & w_{2,2} & \ldots & 0 & 0 & \ldots & 0 \\ \vdots & \vdots & \ddots & \vdots & \vdots & & \vdots \\ 0 & 0 & \ldots & w_{N_{ACF},N_{ACF}} & 0 & \ldots & 0 \end{bmatrix}.$$

The parameter μ may have the value μ=0.0001 in one example. In one system, $N_{DFT}\geqq N_{ACF}$, and the coefficients of the matrix may be:

$$w_{i,i}=1 \text{ for } i\in\{1, \ldots, N_{ACF}\}.$$

Figure 9:
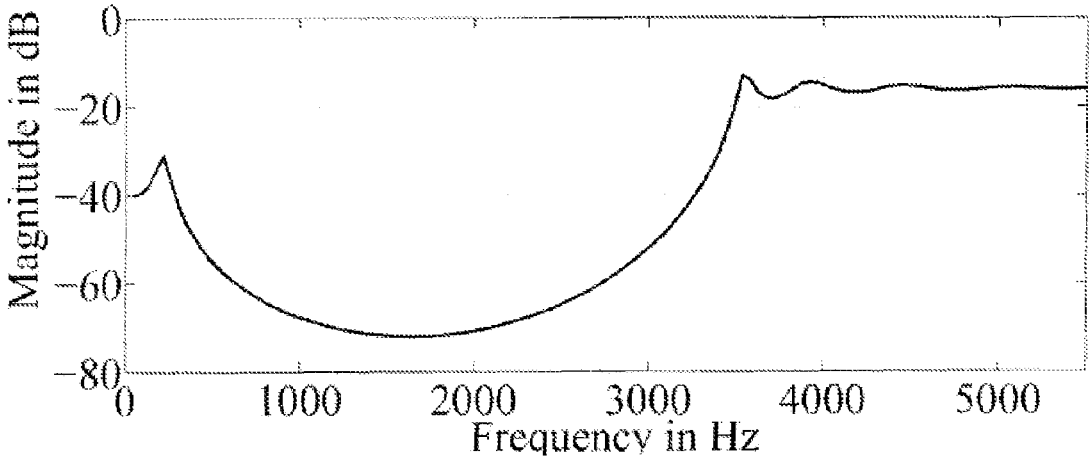
FIG. 9 is a graph of an exemplary frequency response of the auto-correlation of a band elimination filter.
Figure 10:
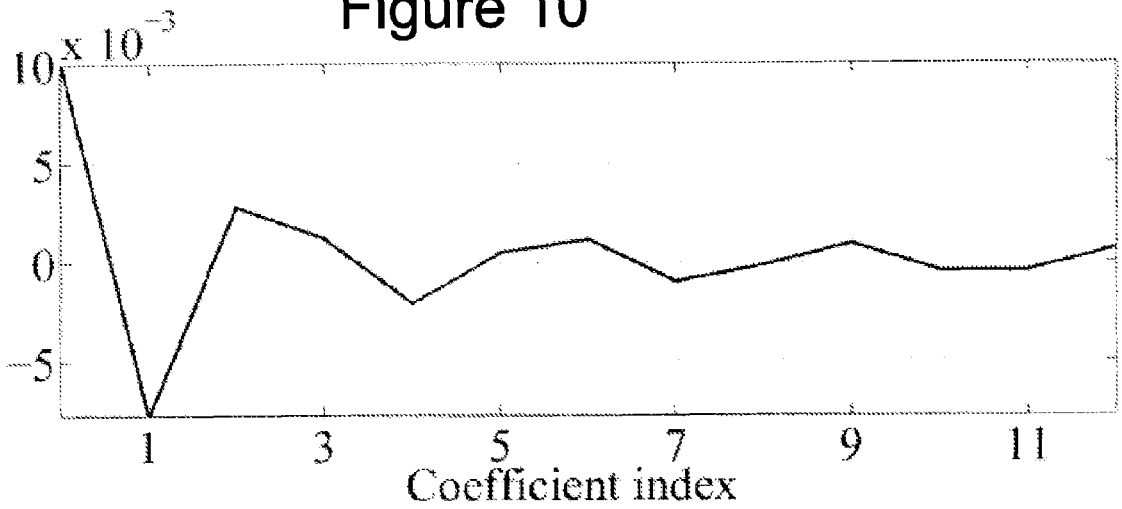
FIG. 10 is a graph of an exemplary corresponding auto-correlation coefficients.

The resulting codebook spectral envelope may be determined at 610. The In resulting codebook spectral envelope:

$$r_{LPC} = \frac{r_{LPC} + r_{mod}}{1 + r_{mod,0}},$$

may be determined as a weighted sum of the envelope auto-correlation coefficients and the frequency response auto-correlation coefficients. The frequency response of the regularization vector $r_{mod}$ corresponding to the frequency response in FIG. 8 is shown in FIG. 9. FIG. 10 is a diagram of exemplary auto-correlation coefficients when $N_{ACF}$=13 that may correspond with the frequency response shown in FIG. 9. The value of an auto-correlation coefficient is shown for a coefficient index. The coefficient index may be the number of the auto-correlation coefficient. The determination of auto-correlation coefficients of the acoustic signal with the frequency response of the band-elimination filter may be used when determining the additive regularization in the time domain. The results that are obtained may be the same for $N_{DFT}\geqq N_{FIR}$ and $N_{ACF}\leqq N_{DFT}-N_{FIR}$.

Figure 11:
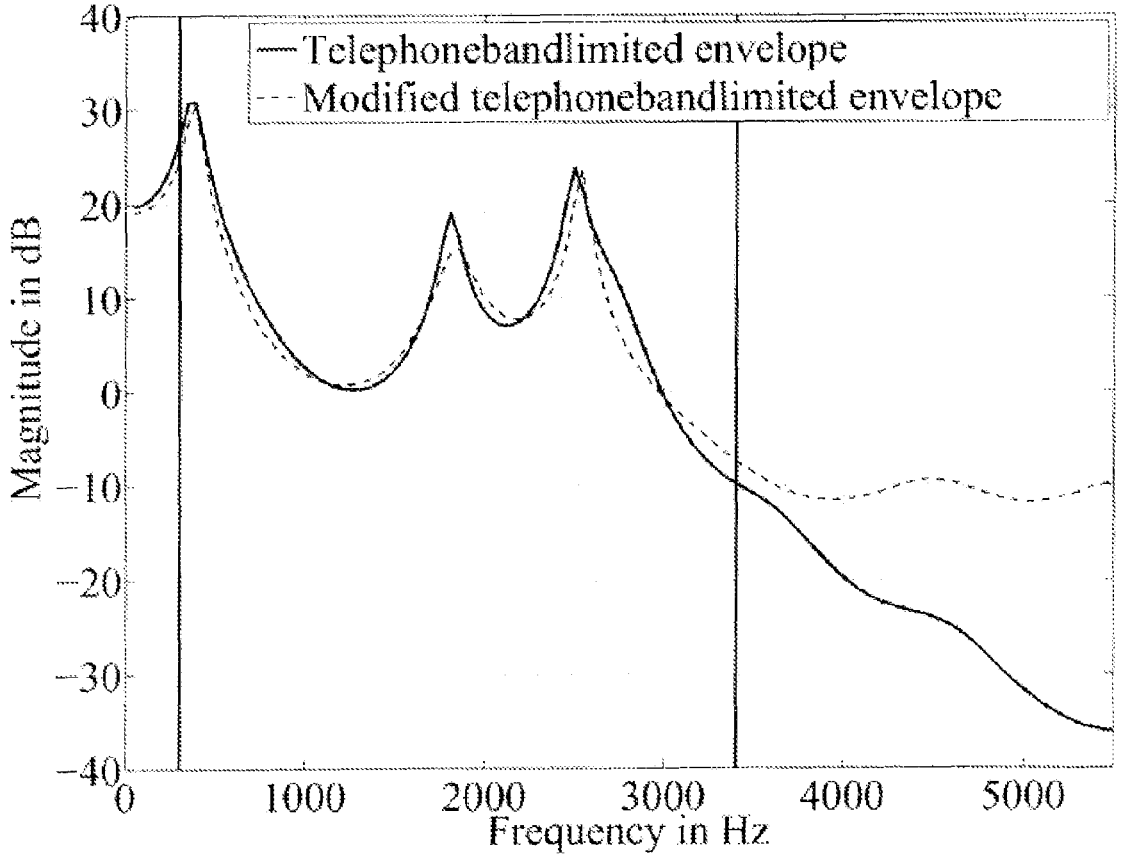
FIG. 11 is a graph of an exemplary frequency responses of narrowband envelopes.

FIG. 11 is exemplary frequency responses of narrowband envelopes. The telephone band limited envelope is a narrowband envelope from a narrow band acoustic signal, such as telephone audio. In addition, FIG. 11 illustrates a codebook spectral envelope for comparison with the narrow band envelope. The modified telephone band limited envelope may be a codebook spectral envelope. The codebook spectral envelope may not differ within the restricted frequency band. However, outside the frequency band limit, the magnitude of the codebook spectral envelope may maintain a magnitude above about −10 dB. Accordingly, FIG. 11 illustrates that outside the restricted frequency band (~3400 Hz), the codebook spectral envelope maintains a minimum magnitude.

Figure 12:
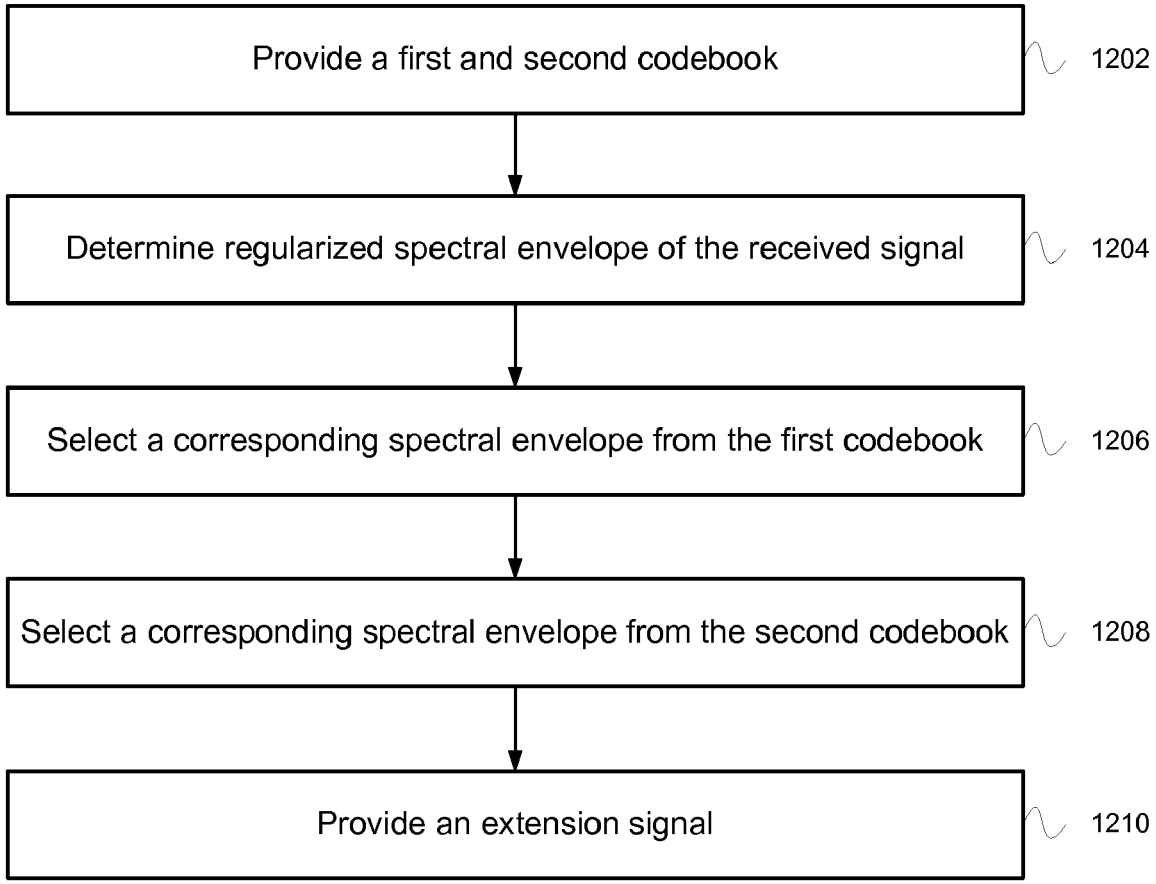
FIG. 12 is process that provides an acoustic signal with an extended bandwidth.

FIG. 12 is a flow diagram for providing an acoustic signal with an extended bandwidth. A first and a second codebook are provided at 1202. The first and second codebooks may include a set of spectral envelopes. The spectral envelopes in the codebooks may correspond with one another. The first codebook may comprise a set of narrowband spectral envelopes. These narrowband spectral envelopes may be based on spectral envelopes of acoustic signals within a restricted frequency band, and may be modified as described with respect to FIG. 6. Accordingly, the spectral envelopes from the first codebook may have been regularized. The second codebook may comprise a set of broadband spectral envelopes and/or spectral envelopes corresponding to broadband acoustic signals. The underlying acoustic signals may contain frequency components outside the restricted frequency band. The additional frequency components may be present below and/or above the limits of the restricted frequency band.

Figure 13:
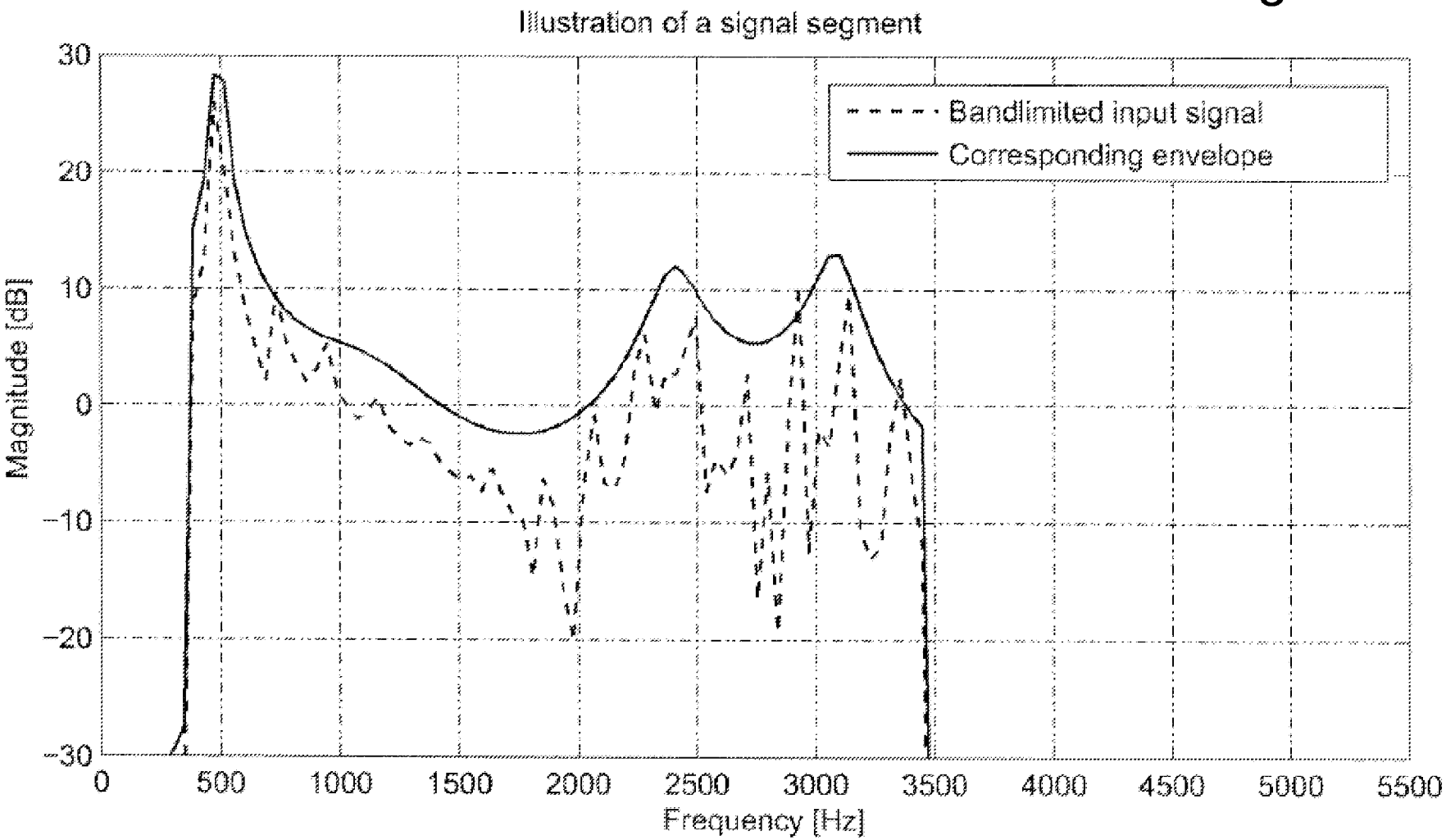
FIG. 13 is a graph of a spectrum from a speech signal and a corresponding envelope.

FIG. 13 is a short time spectrum of a speech signal and a corresponding envelope. The narrowband spectral envelope that is shown in FIG. 13 has not been regularized, as described above. The bandlimited input signal may be a speech signal that is limited between approximately 400 Hz and 3400 Hz. Within that limited frequency band, the corresponding envelope is also shown.

A spectral envelope of the received acoustic signal may be determined at 1204. The received acoustic signal may be a narrowband signal that is restricted to a restricted frequency band. That received signal may be upsampled to a desired sampling rate, as well as undergoing a block extraction and a subsampling to be in a similar form as the signal vectors. These preliminary processing steps may be performed by the upsampler 202 and sub-sampler 204 in FIG. 2.

The spectral envelope may be determined using Linear Predictive Coding and the auto-correlation coefficients described above in the context of determining the codebook spectral envelopes. However, as in the case of the codebook spectral envelopes, the spectral envelopes of the acoustic signal may be modified using additive regularization. The regularized spectral envelope may be obtained as a weighted sum of the envelope auto-correlation coefficients and the frequency response auto-correlation coefficients of the frequency response of a band elimination filter. The frequency response of the band elimination filter may be the same as or similar to the frequency response for the codebook spectral envelopes. In one example, the regularized spectral envelope may be padded to a magnitude of at least about −10 dB outside the limits of the restricted frequency range.

Figure 14:
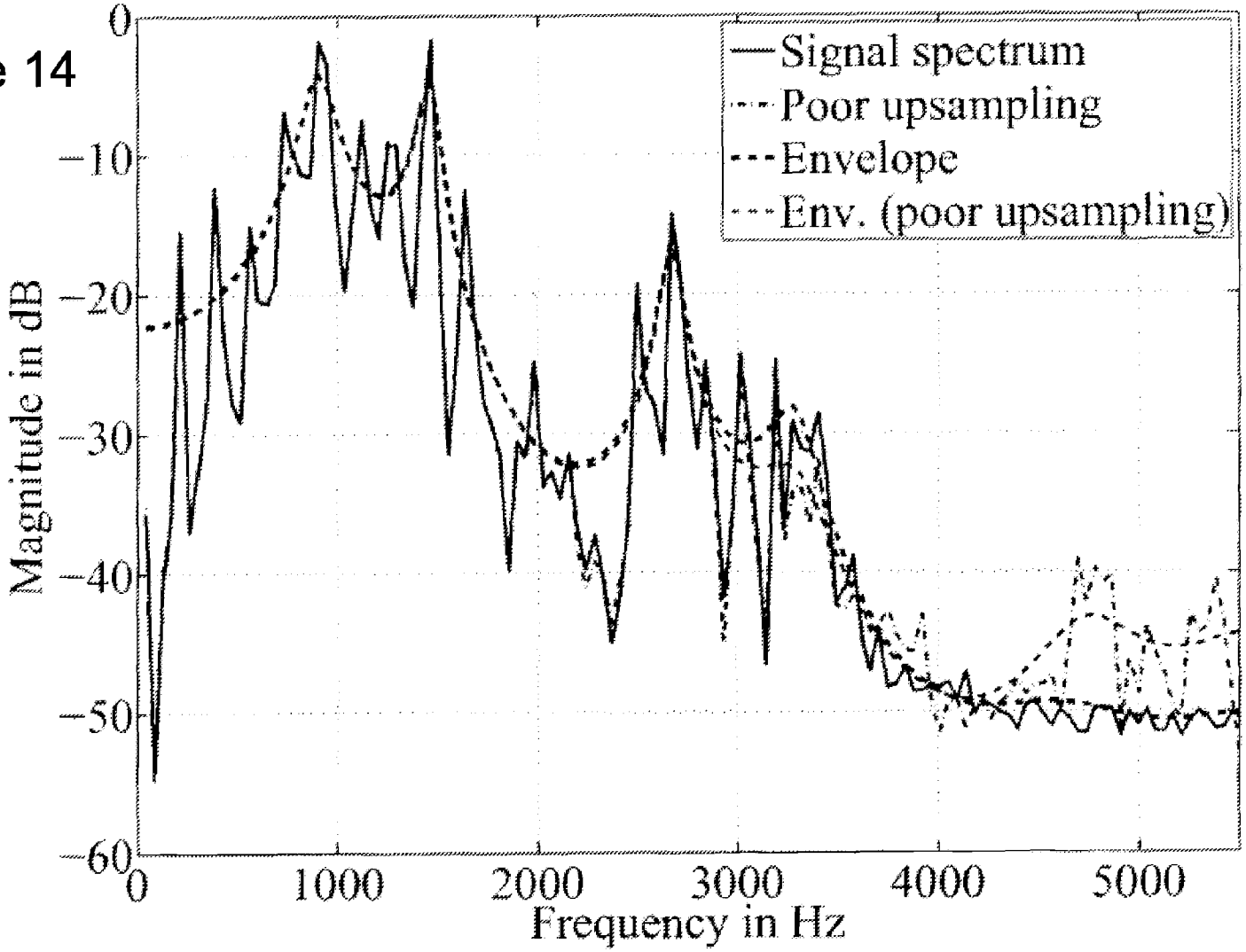
FIG. 14 is a graph of a signal spectra and corresponding spectral envelopes.

FIG. 14 is a signal spectra and corresponding spectral envelopes. The short time signal spectrum of a received acoustic signal is shown. That signal spectrum resulting from an upsampling with poor quality is also depicted. The poor upsampling may result in significant artifacts in the spectrum. The corresponding spectral envelopes for both the signal spectrum and the poor sampling signal spectrum are shown. The spectral envelopes at higher frequencies may differ due to the quality of upsampling. As shown, the spectral envelope above 4 kHz differs based on the upsampling quality.

Figure 15:
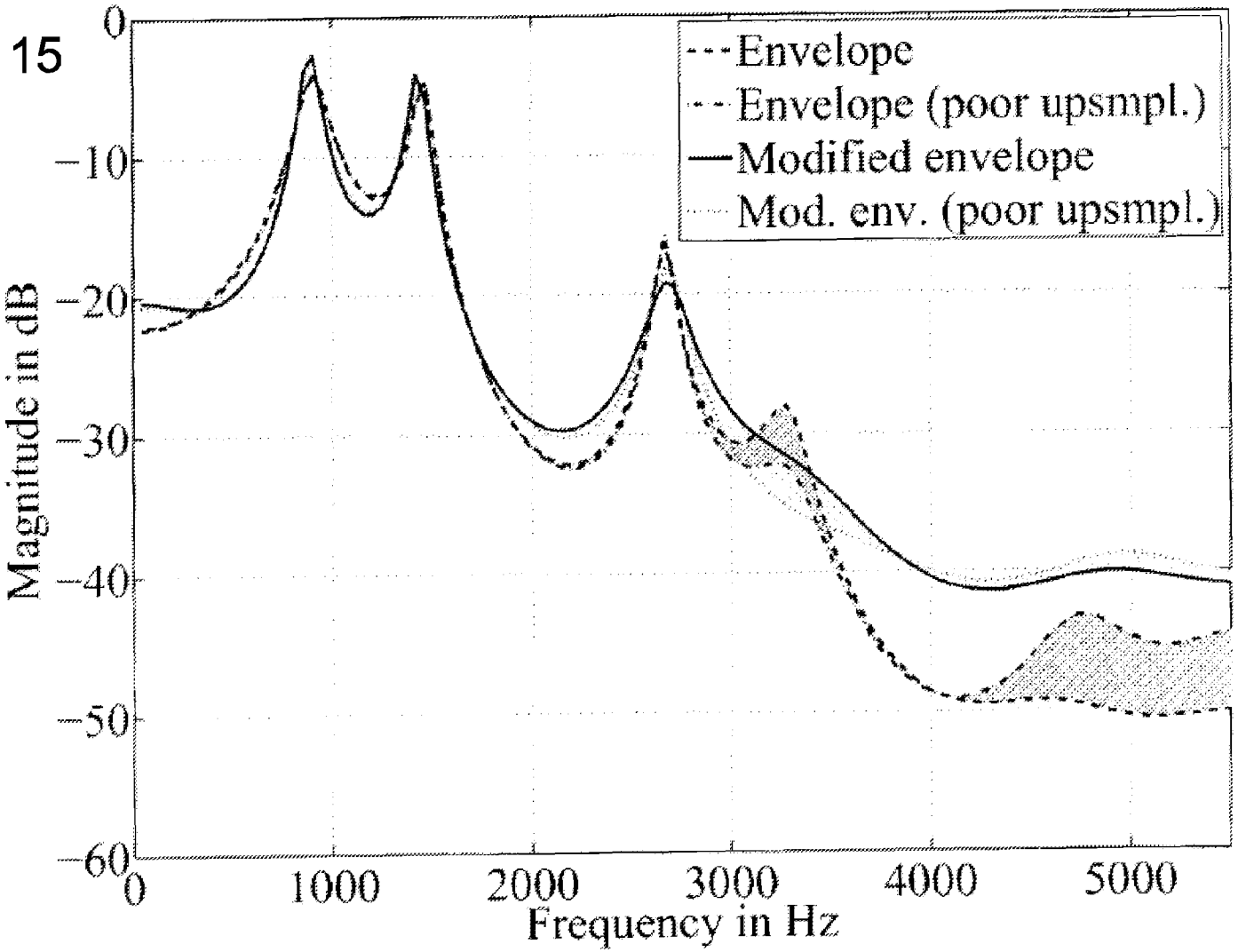
FIG. 15 is a graph of an upsampled spectral envelopes.

FIG. 15 illustrates spectral envelopes after upsampling. The envelopes of a narrowband acoustic signal after an upsampling process with both high quality and low quality are shown. For both spectral envelopes, the corresponding modified/regularized envelopes resulting from the regularization process are also shown. The quality of upsampling may affect the accuracy of the envelopes. The area between the envelope and envelope with poor upsampling is highlighted.

FIG. 15 also illustrates that the spectral envelopes of a received acoustic signal might differ outside the restricted frequency band without the regularization. Although the portion of the envelope outside the restricted frequency band may be less important than the portion inside the frequency band, the components outside the restricted frequency band may result in an incorrect classification when the upsampling process is poor. The incorrect classification of spectral envelopes in codebooks may result in incorrect matching with received signals. A spectral envelope in the codebook might show an overall smaller distance to the envelope of the received acoustic signal although there may be another spectral envelope in the codebook that matches the received acoustic signal more accurately within the restricted frequency band.

Regularization may result in a reduction in the difference between spectral envelopes resulting from the same underlying acoustic signal that have different upsampling processes. Even with poor upsampling, the selection of the closest matching codebook spectral envelope may improve. The regularization of both the codebook spectral envelopes and the spectral envelopes of the received acoustic signal may improve or level steep edges that may occur in band limited signals, such as telephone signals. The comparison between the envelope of an acoustic signal and the codebook envelope may be more focused on the restricted region within the frequency band limits.

Referring to FIG. 12, a comparison between the regularized spectral envelope of the received acoustic signal and the set of spectral envelopes in the first codebook may be performed at 1206. The comparison may include using a distance measure, such as a likelihood ratio distance measure or an Itakuro-Saito distance measure. The spectral envelope from the first codebook showing the smallest distance to the envelope of the acoustic signal may be selected as the closest matching codebook envelope.

A spectral envelope from the set of spectral envelopes in the second codebook may be selected at 1208. The spectral envelopes in the second codebook may correspond with the spectral envelopes in the first codebook. The second codebook may have an extended bandwidth compared to the corresponding spectral envelope of the first codebook.

The selected spectral envelope may be used to provide an extension signal for extending the received acoustic signal at 1210. The extension signal may be based on the selected spectral envelope of the second codebook for extending the received input signal. An excitation signal corresponding to the received acoustic signal may be generated. The excitation signal may show a spectrally flat envelope and correspond to a signal that may be recorded directly behind the vocal cords. The generation of excitation signals may be based on nonlinear characteristics, such as two-way rectifying or squaring. Alternatively, an excitation signal determination may be performed in the time sub-band or Fourier domain as well.

The selected spectral envelope and the excitation signal may be used for spectrally coloring the excitation signal, such as by multiplication in the sub-band or Fourier domain. The spectrally colored excitation signal may passed through an adaptive band-elimination filter to extract the spectral regions that may be used for bandwidth extension so that an extension signal is obtained. The band-elimination filter may suppress signal components within the restricted frequency band. The extension signal and the received acoustic signal may be combined to obtain a resulting signal with extended bandwidth.

The mathematical operators, the filter designs, and the system components may have many different configurations. The system may be implemented as a software algorithm with a digital signal processor. The system may be a feed forward structure, e.g. the calculation of the control function gain (amplitude modulation) derives from the input signal. The audio signals may be transformed to or may be available in a digital format.

The methods discussed above may be encoded in a signal bearing medium, a computer readable medium such as a memory, programmed within a device such as one or more integrated circuits, one or more processors or processed by a controller or a computer. If the methods are performed by software, the software may reside in a memory resident to or interfaced to a storage device, synchronizer, a communication interface, or non-volatile or volatile memory in communication with a transmitter. A circuit of electronic device designed to send data to another location. The memory may include an ordered listing of executable instructions for implementing logical functions. A logical function or any system element described may be implemented through optic circuitry, digital circuitry, through source code, through analog circuitry, through an analog source such as an analog electrical, audio, or video signal or a combination. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine readable medium," "propagated-signal" medium, and/or "signal-bearing medium" may comprise any device that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM", a Read-Only Memory "ROM", an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A computer-implemented method for providing a codebook spectral envelope for bandwidth extension of an acoustic signal comprising:

using a computer to upsample a spectral envelope, where the spectral envelope is limited to a restricted frequency band with a lower limit frequency and an upper limit frequency; and using the computer to modify the upsampled spectral envelope to determine the codebook spectral envelope, wherein modifying the upsampled spectral envelope includes padding the magnitude of the upsampled spectral envelope outside the restricted frequency band to at least one predetermined threshold value.

2. The method according to claim 1 wherein modifying the upsampled spectral envelope to determine the codebook spectral envelope further comprises:

providing a predetermined frequency response of a band elimination filter, where an elimination band corresponds to the restricted frequency band;

determining envelope autocorrelation coefficients of the upsampled spectral envelope; and determining frequency response autocorrelation coefficients of the frequency response, where the codebook spectral envelope is determined using modified autocorrelation coefficients based on a weighted sum of the envelope autocorrelation coefficients and the frequency response autocorrelation coefficients.

3. The method according to claim 2, where the predetermined frequency response comprises a substantially constant magnitude below the lower limit frequency.

4. The method according to claim 3, where the magnitude of the predetermined frequency response is about −20 dB for frequencies below the lower limit frequency.

5. The method according to claim 2, where the predetermined frequency response comprises a substantially constant magnitude above the upper limit frequency.

6. The method according to claim 5, where the magnitude of the predetermined frequency response is about 0 dB for frequencies above the upper limit frequency.

7. The method according to claim 1, where the upsampled spectral envelope comprises a coefficients vector.

8. The method according to claim 7, where the upsampled spectral envelope comprises a Linear Predictive Coding (LPC) coefficients vector.

9. The method according to claim 1, where the bandwidth of the restricted frequency band corresponds to the bandwidth of a telephone band.

10. The method according to claim 9, where the acoustic signal comprises a telephone signal.

11. The method according to claim 1, where the modifying the spectral envelope to determine the codebook spectral envelope further comprises determining linear spectral frequency (LSF) coefficients or cepstral coefficients for the codebook spectral envelope.

12. A computer-implemented method for providing an acoustic signal with extended bandwidth comprises:

providing the acoustic signal where the acoustic signal is restricted to a restricted frequency band with a lower limit frequency and an upper limit frequency;

providing a first codebook comprising a first set of spectral envelopes, each spectral envelope in the first set padded outside the restricted frequency band to at least one predetermined threshold value;

providing a second codebook comprising a second set of spectral envelopes corresponding with the first set of spectral envelopes, where each spectral envelope of the second set of spectral envelopes has an extended bandwidth compared to a corresponding spectral envelope from the first set of spectral envelopes;

using a computer to determine a spectral envelope of the acoustic signal, including modifying the spectral envelope of the acoustic signal such that the magnitude of the spectral envelope outside the restricted frequency band is padded to at least one predetermined threshold value;

using the computer to compare the modified spectral envelope of the acoustic signal with the spectral envelopes from the first codebook;

using the computer to select a spectral envelope from the first codebook based on the comparison with the spectral envelope of the acoustic signal;

using the computer to selecting a spectral envelope from the second codebook corresponding to the selected spectral envelope from the first codebook; and providing an extension signal based on the selected spectral envelope of the second codebook.

13. The method according to claim 12, further comprising combining the acoustic signal and the extension signal by providing a weighted sum of the acoustic signal and the extension signal.

14. The method according to claim 12, where the comparison of the spectral envelope of the acoustic signal with the spectral envelopes from the first codebook is based on a predetermined criterion, and the predetermined criterion is used to identify the selected spectral envelope from the first codebook.

15. The method according to claim 14, where the predetermined criterion comprises a distance measure between the compared envelopes, where the selected spectral envelope from the first codebook has an optimal distance measure with the spectral envelope of the acoustic signal.

16. The method according to claim 15, where the distance measure comprises a likelihood ratio distance measure or an Itakuro-Saito distance measure.

17. The method according to claim 12, where the acoustic signal is bandwidth limited, where the acoustic signal is restricted to a restricted frequency band with a lower limit frequency and an upper limit frequency.

18. The method according to claim 12, where the extension signal comprises an increased bandwidth signal.

19. The method according to claim 12, where modifying the spectral envelope of the acoustic signal further comprises:

providing a predetermined frequency response of a band elimination filter, where the elimination band corresponds to the frequency band of a codebook signal;

using the computer to determine acoustic signal autocorrelation coefficients of the acoustic signal; and using the computer to determine frequency response autocorrelation coefficients of the frequency response; and using the computer to determine the spectral envelope using modified autocorrelation coefficients based on a weighted sum of the acoustic signal autocorrelation coefficients and the frequency response autocorrelation coefficients.

20. A system for providing an acoustic signal with extended bandwidth comprising:

a receiver that receives the acoustic signal, the acoustic signal limited to a restricted frequency band with a lower limit frequency and an upper limit frequency;

a determiner that generates a spectral envelope of the acoustic signal, including modifying the spectral envelope of the acoustic signal such that the magnitude of the spectral envelope outside the frequency band is padded to at least one predetermined threshold value;

a first codebook comprising a first set of spectral envelopes, each spectral envelope in the first set padded outside the restricted frequency band to at least one predetermined threshold value;

a second codebook comprising a second set of spectral envelopes corresponding with the first set of spectral envelopes, where each spectral envelope of the second set of spectral envelopes has an extended bandwidth compared to a corresponding spectral envelope from the first set of spectral envelopes;

a bandwidth extender that receives the modified spectral envelope of the acoustic signal, the first codebook, and the second codebook, where the band width extender selects a spectral envelope from the first codebook based on a comparison with the modified spectral envelope of the acoustic signal; and a generator that provides an extension signal based on a spectral envelope from the second codebook corresponding to the selected spectral envelope from the first codebook.

* * * * *